United States Patent [19]

Nourney

[11] Patent Number: 4,484,508

[45] Date of Patent: Nov. 27, 1984

[54] ELECTROACOUSTIC MUSICAL INSTRUMENT WITH CONTROLLED FADE-OUT

[76] Inventor: Carl-Ernst Nourney, Am Wagnerast 6, D-4000 Düsseldorf 12, Fed. Rep. of Germany

[21] Appl. No.: 464,673

[22] Filed: Feb. 7, 1983

[30] Foreign Application Priority Data

Feb. 12, 1982 [DE] Fed. Rep. of Germany ..... 3204893

[51] Int. Cl.[3] ..... G10H 3/26

[52] U.S. Cl. ..... 84/1.05; 84/1.13; 84/1.16; 84/DIG. 10

[58] Field of Search ..... 84/1.04–1.06, 84/1.13–1.16, DIG. 10

[56] References Cited

U.S. PATENT DOCUMENTS 2,001,723 5/1935 Hammond, Jr. ..... 84/1.05

4,236,433 12/1980 Holland ..... 84/1.16

*Primary Examiner*—Stanley J. Witkowski

*Attorney, Agent, or Firm*—Karl F. Ross; Herbert Dubno

[57] ABSTRACT

A musical instrument with a plurality of vibratile tone generators, whose oscillations are converted into alternating currents by electroacoustic transducers, is provided with a control circuit feeding back a regenerative vibratory signal of progressively diminishing amplitude to maintain the oscillations of a previously activated tone generator for a selected fade-out period. The duration of the fade-out period can be controlled by the player, e.g. with the aid of a pedal, by varying the time constant of a peak-storage network connected to the feedback loop. The feedback signal may be transmitted to the respective tone generator by a mechanical vibrator attached to the instrument body or by sound waves emitted from a loudspeaker. The player may also switch from the output of the peak-storage network to a constant control signal for sustained reverberation.

14 Claims, 1 Drawing Figure

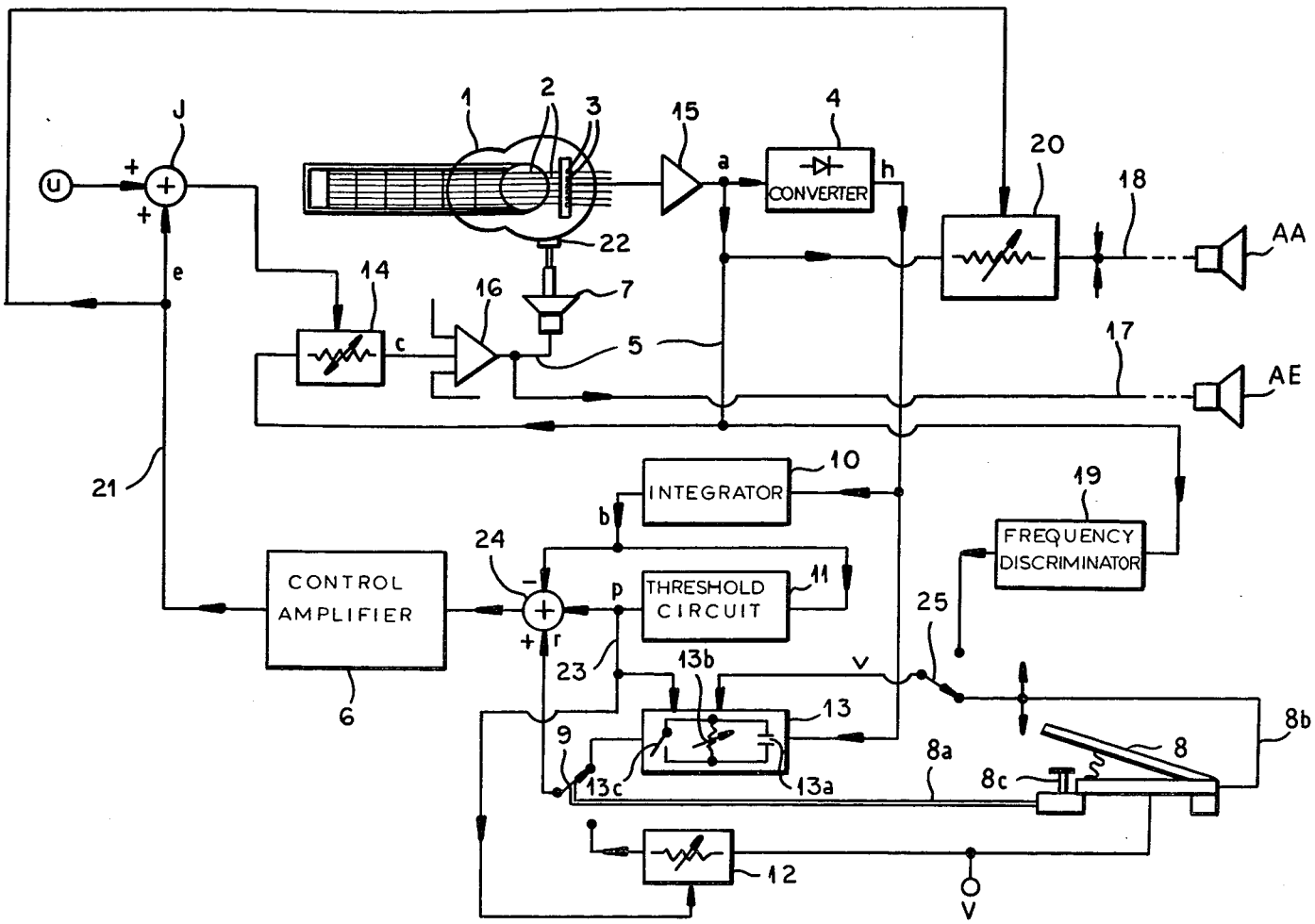
AA
AE
18
17
20
19
FREQUENCY DISCRIMINATOR
8b
8
8c
8a
25
V
h
4
CONVERTER
a
15
10
INTEGRATOR
11
THRESHOLD CIRCUIT
13
13a
13b
13c
12
3
2
1
22
7
5
16
14
c
b
p
23
9
r
24
CONTROL AMPLIFIER
6
J
e
21
U

ELECTROACOUSTIC MUSICAL INSTRUMENT WITH CONTROLLED FADE-OUT

FIELD OF THE INVENTION

My present invention relates to a musical instrument of the electroacoustic type having strings, tongues, bars or the like—referred to hereinafter as vibratile tone-generating means—that can be excited into free oscillations by a player. Typical instruments of this type are those with plucked strings, such as guitars, but my invention also applies to instruments such as electroacoustic pianos or vibraphones with tone-generating means struck by hammers or mallets.

BACKGROUND OF THE INVENTION

In the instruments here contemplated, the oscillations of the several tone generators thereof are picked up by associated electroacoustic transducers converting them into electric audio signals. These transducers may operate inductively, capacitively or piezoelectrically, for example; they may also be constituted by strain gauges on a string-supporting bridge as described in my prior U.S. Pat. Nos. 4,228,715 and 4,292,875. The transducers are provided with output circuitry for acoustically reproducing the oscillations of the corresponding tone generators, usually through a loudspeaker, after suitable amplification. That output circuitry may further include certain components, such as dynamic-range compressors and sustainers, for electronically controlling the period during which an audio signal persists beyond the instant of excitation of the associated tone generator and for establishing a selected fade-out rate during that period; circuitry of that kind is known primarily from electronic music synthesizers, e.g. as described in U.S. Pat. No. 4,336,734 and others referred to therein.

The aforedescribed components of electronic synthesizers, however, do not operate satisfactorily in electroacoustic instruments designed to produce natural-sounding tones in the fade-out phase. The length of the fade-out period is limited by the extent to which the generated audio signal can be amplified within an acceptable signal-to-noise ratio. When the noise becomes excessive, the amplification must be instantly terminated so as to cut off the sound. This is inconsistent with natural tone perception.

OBJECTS OF THE INVENTION

The general object of my present invention, therefore, is to provide an improved electroacoustic musical instrument with means for controlling fade-out in a natural-sounding way and with avoidance of the aforementioned noise problem.

A more particular object is to facilitate the establishment of different fade-out periods under the control of the player.

It is also an object of my invention to provide means letting a player choose between controlled fade-out and sustained reverberation.

SUMMARY OF THE INVENTION

I have found, in accordance with my present invention, that the aforestated objects can be achieved by including the tone-generating means in a system designed to maintain the audio signals and their acoustic reproduction for an extended and preferably variable period beyond the moment of original excitation—e.g. the plucking of a string—by the player. I therefore provide vibratory re-excitation means operatively coupled with the tone-generating means and connected via a regenerative loop to the output circuitry of the instrument for maintaining the tone-generating means in an oscillatory state in response to a feedback signal derived from the audio signals. The feedback loop includes amplitude-modulating means connected to supervisory means for damping the feedback signal to control the duration of the oscillatory period.

Pursuant to a more particular feature of my invention, the supervisory means comprises an integrator connected to the output circuitry for deriving a mean-amplitude signal from the audio signals transmitted thereto, a memory for storing a peak value of these audio signals which occurs immediately upon activation of the tone-generating means, and a comparator of algebraic adder for differentially combining the mean-amplitude signal with a diminishing reference signal obtained from the memory with the aid of a discharge path progressively reducing the magnitude of the stored value, the comparator feeding an error signal to a control input of the amplitude-modulating means.

The discharge path of the memory may comprise adjustable impedance means for varying the rate of diminution of the reference signal under the control of setting means which could be a player-operable signal source, e.g. a pedal, but could also be a frequency discriminator connected to the output circuitry of the instrument in order to modify the rate of diminution according to the fundamental frequency of a concurrently generated oscillation, as more fully described hereinafter.

A further advantageous feature of my invention resides in the provision of switchover means operable by the player for selectively connecting an input of the comparator either to the peak memory or to a supply of an alternate reference signal of constant magnitude.

The vibratory re-excitation means operatively coupled with the tone-generating means as part of the regenerative-feedback loop may be mechanically coupled with the instrument body, e.g. with the rib of a guitar provided with the usual soundboard. When the body of a guitar or similar string instrument is of the solid or nonresonant type, the feedback may also take place by way of the string-supporting bridge. A further possibility is to use a loudspeaker acoustically coupled with one or more tone generators through an intervening air gap; such a loudspeaker could, in fact, be one serving for the audible reproduction of the generated oscillations.

A single loudspeaker or other vibratory exciter may have its input connected through a summing stage to a plurality of channels of the feedback loop serving the respective tone generators. It should be noted, however, that the instrument may include tone generators not provided with such feedback channels and thus not subject to fade-out or sustaining control as discussed above.

BRIEF DESCRIPTION OF THE DRAWING

The above and other features of my invention will now be described in detail with reference to the accompanying drawing the sole FIGURE of which is a block diagram schematically showing a representative embodiment.

SPECIFIC DESCRIPTION

In the drawing I have shown a musical instrument 1, specifically a guitar, with strings 2 to be plucked by a player, the strings being mounted on the instrument body in close proximity to respective electroacoustic transducers 3 which may be strain gauges carried on a bridge as described and illustrated in my above-identified prior patents. These transducers have individual output circuits of which, however, only one has been shown and will be described in detail. That output circuit comprises a preamplifier 15 whose output is connected, together with those of the other preamplifiers not shown, via an amplitude limiter or damping circuit 20 to an outgoing lead 18 terminating at a load AA such as a loudspeaker or group of loudspeakers in an auditorium. Lead 18, which may include additional amplifier stages, carries the electric audio signal a, corresponding to the oscillations of the string 2 associated with preamplifier 15, along with similar output signals from further preamplifiers if other strings are excited at the same time. The pitch of string 2 may correspond, for example, to the diapason normal. The lower-case letters designating certain signals correspond, in part, to those appearing in FIG. A-1 of the chapter "Theory of Servomechanisms" of the book "Servomechanism Practice" by W. R. Ahrendt and C. J. Savant, Jr., Ph.D., published 1960 by McGraw-Hill Book Company, Inc.

A signal converter 4 connected to the output of preamplifier 15, essentially consisting of a half-wave rectifier, changes the bipolar signal a into a unipolar signal h, i.e. into a pulsating current. Signal h is applied in parallel to an integrator 10 and to a peak memory 13. Integrator 10, which may be a low-pass filter, derives from signal h a more gradually varying signal be proportional to the mean amplitude of output signal a. An algebraic adder 24 compares this signal b with a reference signal r which, in the illustrated position of a switch 9, is delivered by the peak memory 13. The latter, resembling a conventional sample-and-hold circuit, is shown schematically as including a storage capacitor **13*a* and an adjustable resistor 13*b* connected in a discharge path thereacross. The capacitor is charged through a nonillustrated one-way component, such as an operational amplifier, to the highest value of the unipolar voltage h emitted by converter 4. There is also shown a short-circuiting switch 13*c*, i.e. an electronic gate, serving for the quick discharge of capacitor 13*a* in response to a termination pulse p appearing on an output lead 23 of a threshold circuit 11 which also receives the mean-amplitude signal b from integrator 10. Circuit 11** is triggered by a predetermined decrease of signal b, i.e. whenever its absolute value drops below a certain level or when the decay rate of that signal—as determined by a differentiator—exceeds a given limit.

Switch 9 is mechanically controlled, via a link **8*a*, by a player-operated pedal 8 which also includes a potentiometer (not shown) connected to a voltage source V. An output lead 8*b* of that potentiometer is connected, in the illustrated position of a manual switch 25, to a control input of peak memory 13 to apply thereto a setting command v which adjusts the discharge resistance 13*b* to an extent determined by the position of pedal 8. The player, therefore, may vary the discharge time—e.g. lengthen it—by stepping on the pedal; lead 8*b* has several branches extending via respective armatures of switch 25 to all the peak memories associated with the respective transducers 3, preamplifiers 15 and converters 4. When the pedal 8 is fully depressed, it displaces a spring-loaded lug 8*c* to reverse the switch 9 which thereupon connects the additive input of comparator 24 to voltage source V by way of a manually adjustable level selector 12 whereby reference signal r assumes a value determined by the setting of that selector. Lead 23 is also connected to a blocking input of level selector 12 for disconnecting the switch 9 from voltage supply V whereby reference signal r goes to zero regardless of the position of that switch whenever threshold circuit 11** is active.

An error signal e, proportional to the difference between the mean-amplitude signal b on the subtractive input and the reference signal r on the additive input of comparator 24, is emitted on a lead 21 by a bipolar control amplifier which is connected to the comparator output and preferably has a low-pass characteristic. Lead 21 further extends to a control input of amplitude limiter 20. A junction J, which has no physical significance, symbolizes points anywhere in the system in which the error signal e or its contributing signal b is encumbered by a disturbance u. The encumbered error signal arrives at a control input of an amplitude modulator 14 which lies in a feedback loop 5 extending from the output of preamplifier 15 so as to carry the audio signal a. Modulator 14 changes the amplitude of that audio signal so as to produce a feedback signal c which is fed via a power amplifier 16 to a vibratory exciter 7; the latter is shown to be designed as a loudspeaker whose diaphragm, however, also has an extension 22 mechanically connectable with the body of instrument 1. The latter connection will be used when that body is a resonant belly with a soundboard, as discussed above; even if that body is nonresonant, any string 2 will be acoustically reverberated by sound waves from this loudspeaker if its natural frequency (as modified by any fret onto which it is pressed) corresponds to one of the components of that wave. Power amplifier 16 also receives similar feedback signals from other channels of loop 5. The drawing further shows a lead 17 extending from the output of amplifier 16 to an ancillary load AE such as one or more additional loudspeakers designed to generate an echo effect, taking into account the delay introduced by the feedback.

The adjustable impedances symbolized by variable resistances at 12, **13*b*, 14 and 20 are preferably constituted by electronic devices such as field-effect transistors of the insulated-gate (IGFET) type. Thus, for example, components 14 and 20 may comprise IGFETs of the enhancement and the depletion type, respectively, with gates tied to lead 21. In normal operation, with mean-amplitude signal b at most equal to reference signal r, error signal e on lead 21 will be of one polarity (e.g. positive) or zero. If, however, the feedback should become excessive so that $b>r$, the polarity of signal e will be reversed so that modulator 14 will become substantially nonconductive while the normally fully conductive amplitude limiter 20** will attenuate its outgoing signal component.

With storage capacitor **13*a* of memory 13 assumed to be initially discharged, the plucking of a string 2 by the player generates signals a and h, thereby charging the capacitor 13*a* to the peak of the largest amplitude. When switch 9 is in its illustrated position, the capacitor charge determines the magnitude of reference signal r fed to comparator 24 which, of course, must have a very high input impedance so as not significantly to contribute to the dissipation of that charge. With suitable design of the active and passive circuit elements of components 10 and 11, the magnitude of signal b differs but little from that of signal r at this time. The resulting error signal e allows modulator 14 to pass a feedback signal c sufficient to maintain the oscillation of the plucked string 2 at or near its original level. With the capacitor charge gradually leaking off via discharge impedance 13***b*, reference signal r diminishes over a number of oscillatory cycles so that error signal e and feedback signal c also decrease. If the string is not being plucked again at this stage, the amplitude of its oscillation and that of audio signal a will be correspondingly reduced so that the controlled signal b follows the reference signal r whose rate of decay is determined by the setting of impedance 13*b*. The player, therefore, may control that rate by stepping more or less heavily on pedal 8 to lengthen or shorten the ensuing fade-out period which ends when threshold circuit 11 emits the terminating pulse p upon detecting a certain decrease in signal b as discussed above; pulse p is also fed to a blocking input of comparator 24 for cutting off the error signal e. The rapid discharge of capacitor 13*a* by the temporary closure of switch 13*c* allows that capacitor to be recharged to a new voltage peak when the associated string is again plucked.

If the player wishes to sustain the oscillation of the excited string for an indefinite period, a full depression of pedal 8 will switch the additive input of comparator 24 to the output of level selector 12 so that reference signal r will have a constant value, which may be manually adjusted, establishing a chosen volume for the tone generated by the excited string. The reverberation of that string will be terminated immediately when the player mutes the string by the touch of a finger, with resulting activation of threshold circuit 11 by the disappearance of signal h, or else the player may switch back to peak memory 13 for a gradual fade-out.

In the drawing I have also shown a frequency discriminator 19 with an input connected to the output of preamplifier 15 in order to detect the fundamental frequency of audio signal a. With switch 25 moved into its alternate position, discriminator 19 controls the rate of discharge of storage capacitor 13*a* according to the magnitude of that fundamental frequency. Since the decay period of the oscillations of a momentarily excited string or other tone generator varies inversely with pitch, this mode of operation likewise generates a natural-sounding fade-out effect. Discriminator 19 could also be connected to the output of converter 4 carrying the raw-rectified signal h.

The control of output signal a by the loop 5 has the further advantage of preventing the undesirable kind of acoustic feedback dreaded by performers in a concert hall, auditorium or other closed environment.

I claim:

1. A musical instrument comprising:

vibratile tone-generating means excitable into free oscillations by a player;

electroacoustic transducer means juxtaposed with said tone-generating means for converting the oscillations thereof into electric audio signals;

output circuitry connected to said transducer means for acoustically reproducing said oscillations from said audio signals;

vibratory re-excitation means operatively coupled with said tone-generating means and connected via a regenerative loop to said output circuitry for maintaining said tone-generating means in an oscillatory state for an extended period in response to a feedback signal derived from said audio signals;

amplitude-modulating means in said loop; and supervisory means connected to said amplitude-modulating means for damping said feedback signal to control the duration of said extended period;

said supervisory means comprising integrating means connected to said output circuitry for deriving a mean-amplitude signal from said audio signals, memory means for storing a peak value of said audio signals occurring immediately upon activation of said tone-generating means, said memory means including a discharge path for progressively reducing the magnitude of the stored value to provide a diminishing reference signal, and comparison means for differentially combining said means-amplitude signal with said reference signal to produce an error signal fed to a control input of said amplitude-modulating means.

2. A musical instrument as defined in claim 1, further comprising adjustable impedance means in said discharge path and setting means coupled to said impedance means for varying the rate of diminution of said reference signal.

3. A musical instrument as defined in claim 2 wherein said setting means comprises a player-operable signal source.

4. A musical instrument as defined in claim 3 wherein said signal source is a pedal.

5. A musical instrument as defined in claim 2 wherein said setting means comprises a frequency discriminator connected to said output circuitry for modifying said rate of diminution according to the fundamental frequency of a concurrently generated oscillation.

6. A musical instrument as defined in claim 1, further comprising switchover means operable by the player for selectively connecting an input of said comparison means either to said memory means or to a supply of an alternate reference signal of constant magnitude.

7. A musical instrument as defined in claim 1, further comprising threshold means inserted between said integrating means and said memory means for rapidly discharging the latter in response to a predetermined decrease of said mean-amplitude signal.

8. A musical instrument as defined in claim 7, further comprising switchover means operable by the player for selectively connecting an input of said comparison means to said memory means and to a supply of an alternate reference signal of constant magnitude, said threshold means blocking said alternate reference signal in response to said predetermined decrease of said mean-amplitude signal.

9. A musical instrument as defined in claim 8, further comprising adjustable impedance means in said discharge path and a player-operable signal source coupled to said impedance means for varying the rate of diminution of said reference signal, said switchover means being linked with said signal source.

10. A musical instrument as defined in claim 9 wherein said signal source is a pedal.

11. A musical instrument as defined in claim 1, further comprising damping means in said output circuitry coupled to an output of said comparison means for attenuating the reproduced oscillations in response to a control signal indicative of excessive feedback.

12. A musical instrument as defined in claim 11 wherein said integrating means is connected to said output circuitry at a point between said transducer means and said damping means.

13. A musical instrument as defined in claim 1 wherein said vibratory re-excitation means comprises a loudspeaker acoustically coupled with said tone-generating means.

14. A musical instrument as defined in claim 1 wherein said tone-generating means comprises a string mounted on a resonant body, said vibratory re-excitation means being mechanically coupled with said body.

* * * * *